US007104829B2

(12) United States Patent
Volpone et al.

(10) Patent No.: US 7,104,829 B2
(45) Date of Patent: Sep. 12, 2006

(54) CONNECTOR WITH LOCKING ARM HAVING A WINDOW

(75) Inventors: Thomas A. Volpone, Cortland, OH (US); Dale J. Smutny, Canfield, OH (US); Daniel J. Erdman, West Middlesex, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/087,394

(22) Filed: Mar. 23, 2005

(65) Prior Publication Data

US 2005/0221652 A1 Oct. 6, 2005

Related U.S. Application Data

(60) Provisional application No. 60/555,619, filed on Mar. 23, 2004.

(51) Int. Cl.
*H01R 13/626* (2006.01)
*H01R 13/64* (2006.01)

(52) U.S. Cl. ..... 439/358; 439/680

(58) Field of Classification Search ..... 439/350–358, 439/542, 660, 680
See application file for complete search history.

(56) References Cited

U.S. PATENT DOCUMENTS

| | | | | |
|---|---|---|---|---|
| 6,129,593 | A * | 10/2000 | Aoyama et al. | 439/701 |
| 6,179,643 | B1 * | 1/2001 | Fukuda | 439/358 |
| 6,280,226 | B1 | 8/2001 | Takatsuki et al. | |
| 6,319,043 | B1 | 11/2001 | Takatsuki et al. | |
| 6,341,975 | B1 | 1/2002 | Takatsuki et al. | |
| 6,837,751 | B1 | 1/2005 | Vanden Wymelenberg et al. | |

* cited by examiner

*Primary Examiner*—James R. Harvey
(74) *Attorney, Agent, or Firm*—David P. Wood

(57) ABSTRACT

A connector includes a housing, a base extending from an outer surface of the housing, and a deflectable, cantilever locking arm extending from an outer surface of the base. A window is formed in the locking arm at a location proximate the base. The locking arm and base are shaped to resist breakage of the locking arm and base when the lock arm is bent away from the outer surface of the housing.

19 Claims, 3 Drawing Sheets

CONNECTOR WITH LOCKING ARM HAVING A WINDOW

The benefit of a provisional application U.S. Ser. No. 60/555,619, filed Mar. 23, 2004, entitled CONNECTOR WITH LOCKING ARM is hereby claimed.

TECHNICAL FIELD

This invention relates generally to electrical connectors, and more particularly, to electrical connectors that include one or more flexible locking arms configured to positionally retain the electrical connector with respect to mating structure.

BACKGROUND OF THE INVENTION

Electrical connectors typically comprise one or more conductive contacts at least partially protected by non-conductive housing structure. Often, such electrical connectors include one or more locking features configured to position the connector or its housing structure relative to a mating connector and/or some other structure such as, for example, a wall of a device within which a mating connector resides, a junction box, a vehicle, and the like. One example of such an electrical connector includes a locking feature comprising a flexible arm extending from the housing of the connector and including a feature (e.g., a hook) that is configured to engage a complementary feature (e.g., a loop) on a mating connector or other structure.

Often, the locking arm of such connectors are configured and positioned so as to define a space between the locking arm and the outer surface of the connector housing. This space may be configured to accommodate the housing structure of a mating connector (e.g., to form a seal), and the locking arm may also be configured to deform sufficiently to enable it to engage a corresponding locking feature on the mating structure. Accordingly, the locking arm may be configured as a cantilevered beam structure, fixedly attached to a base structure at one end and extending from the base structure over the connector housing to mate with a corresponding feature on a mating element. The base structure, then is positioned on the connector housing.

Unfortunately, experience has shown that connectors having such cantilevered locking arms are prone to a number of problems related to the failure and lack of reliability of the locking arm. For example, during assembly, foreign matter may become lodged within the space between the locking arm and the outer surface of the connector housing, resulting in excessive deformation of the locking arm as it is mated. Similarly, the locking arm may inadvertently catch one or more wires or other structure in a host device. If the trapped wire and the connector are subsequently moved relative to one another, the wire may cause the locking arm to deform excessively (e.g., displacing the locking arm away from the adjacent surface of the connector housing). Still further, while such connectors are handled during packaging, assembly or repair of a host device, they may be passed through small holes or may otherwise be physically manipulated within cramped spaces, commonly resulting in excessive deformation of the flexible arm of the locking feature. Such deformation may be considered excessive if it significantly exceeds the level or frequency of deformation normally associated with the intended function of the arm, which is to engage and accommodate a corresponding structure (e.g., to traverse a retainer step on a mating connector).

As a result of such excessive deformation, the locking arm of the connector may become weakened through fatigue or may even fail at a location where stresses are concentrated such as at the point where the arm is fixed to the base. As a result, the reliability of the position assurance and/or locking function, and therefore of the connector and possibly its host device, may be compromised.

Prior attempts to address this issue have produced locking arm designs that include a groove formed into the flexible arm and its base, such that the cross-sectional area of the material at both the base of the arm and in the arm itself is smaller than the cross-sectional area where the arm and its base is fixed to the connector body. In practice, when the arm of such connectors are deformed beyond a strain limit inherent in the material, a hinge is induced at or near where the arm meets its base. Unfortunately, this solution often causes the material displaced at the induced hinge of the bend to buckle (i.e., to "bunch up"), causing additional material interference as the arm deforms. Such material interference, in turn causes additional strain to be concentrated in the vicinity of the induced hinge.

Accordingly, a need exists for a connector having a flexible arm that can resist, or better tolerate, deformation of the arm away from the connector housing, while avoiding excessive material interference in the area of the induced hinge.

SUMMARY OF THE INVENTION

To address various deficiencies in the prior art, this invention provides a connector having an improved locking arm of the type that resists breakage as the locking arm is bent away from the connector housing. In one aspect, the invention provides a structure that accommodates increased deformation of the arm while minimizing the displacement of material and the corresponding likelihood of material interference at the induced hinge of the arm. In another aspect, the invention provides a window for accommodating material that may be displaced as the locking arm is deformed. This window further minimizes the occurrence of material interference that may otherwise be caused by the displacement of material at the hinge point. As a result, the connector is enabled to tolerate increased deformation of the locking arm without failing or encountering excessive strain fatigue in the region of the induced hinge.

According to an exemplary embodiment of a connector according to the present invention, the connector comprises a housing having an outer surface, a base extending from the outer surface, and a deflectable, cantilevered arm extending from the base. The locking arm may be formed integrally with the housing and the base, and the locking arm may further include a locking feature, a position assurance feature, and/or an alignment feature for engaging a cooperating feature at the distal end of the arm.

In an exemplary embodiment, the base and the locking arm may be configured so as to position an induced hinge axis, about which the locking arm substantially rotates as the locking arm deforms under stress. In an exemplary embodiment, the base and the locking arm are configured so as to position the induced hinge in the locking arm substantially adjacent to the base.

In an exemplary embodiment, the locking arm includes a plurality of spaced-apart members defining a window therebetween and concentrating stress in the spaced-apart members as the arm is deformed. In an exemplary embodiment, the spaced-apart members may be flexible and may extend in parallel relation to one another. In an exemplary embodiment, the window is defined in the region of the induced hinge. In another exemplary embodiment, the window extends from the base to a distal end of the arm. In yet another exemplary embodiment, one or more indentation may be formed in an outer surface of each flexible member to create a location of elevated stress concentration, thereby positioning the induced hinge proximate the indentation when the locking arm is caused to deform outwardly from the connector housing. In yet another exemplary embodiment, a beam width of each flexible member is less than the beam height of the locking arm.

In an exemplary embodiment, the base may be configured to define a void adjacent to the arm. Accordingly, the base may bear a cross-section that is substantially rectangular with a concave feature formed adjacent to the axis of the induced hinge. The base may further be configured so that the void in the base is adjacent to, and contiguous with, the window defined in the arm. The base may further be configured so that a width of the void in the base is equal to or greater than a maximum cross-sectional dimension of the arm. Alternatively the base may be configured so that a width of the void in the base is equal to or greater than a maximum cross-sectional dimension of a member of the arm.

In yet another aspect of the invention, the external surface of the base may be configured to define a continuous arcing transition from a side of the base that is adjacent to the arm to a side of the base that is substantially perpendicular to the arm and that extends outwardly from the connector housing. In an exemplary embodiment, the external surface of the base may also be configured to define a continuous arc from an exterior side surface of the base to a surface of the base within the void defined in the base. Finally, the base may be configured as a solid block (e.g., a structure having a rectangular cross-section and therefore lacking any groove or window) so as to provide optimum rigidity in portions of the structure where deformation is not desired.

These and other features and advantages of the present invention will be apparent from the following brief description of the drawings, detailed description, claims, and appended drawings.

BRIEF DESCRIPTION OF THE DRAWINGS

The above-mentioned features of the present invention can be more clearly understood from the following detailed description considered in conjunction with the following drawings, in which like numerals represent like elements and in which.

DETAILED DESCRIPTION OF THE INVENTION

Figure 1:
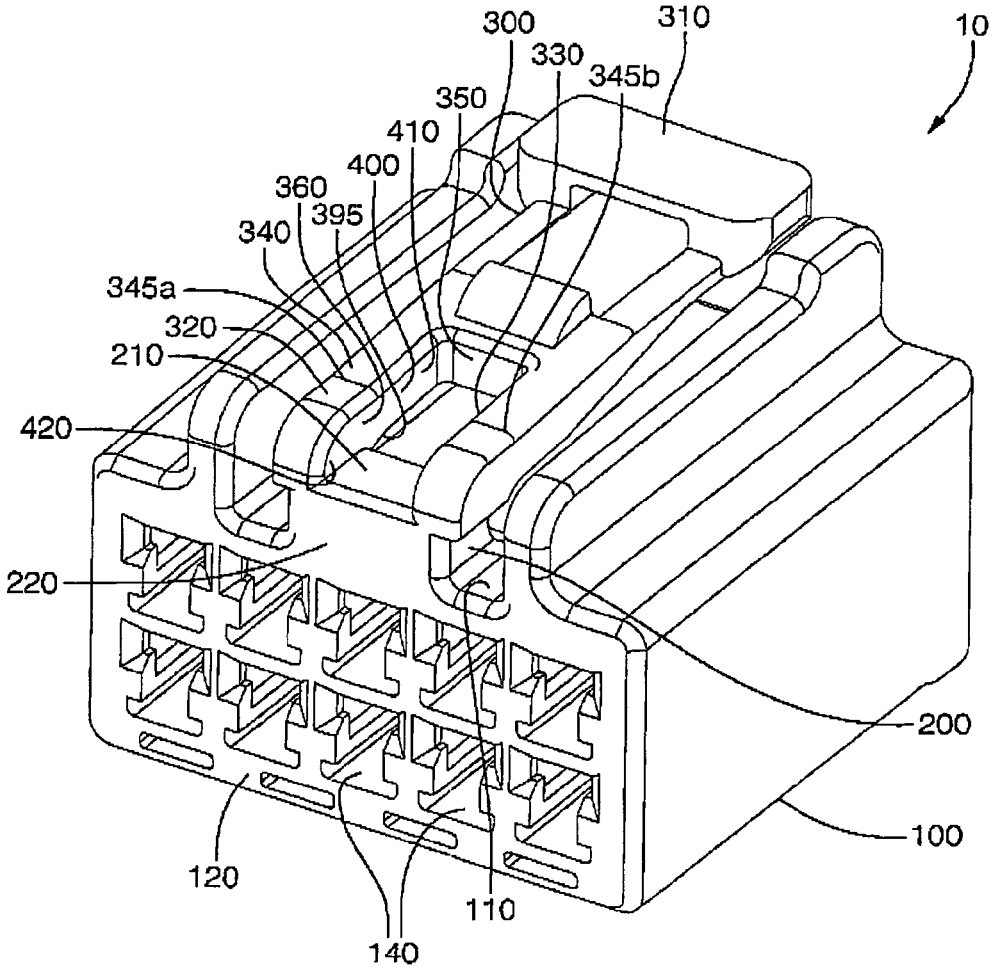
FIG. 1 is a perspective view showing a connector according to the present invention.
Figure 2:
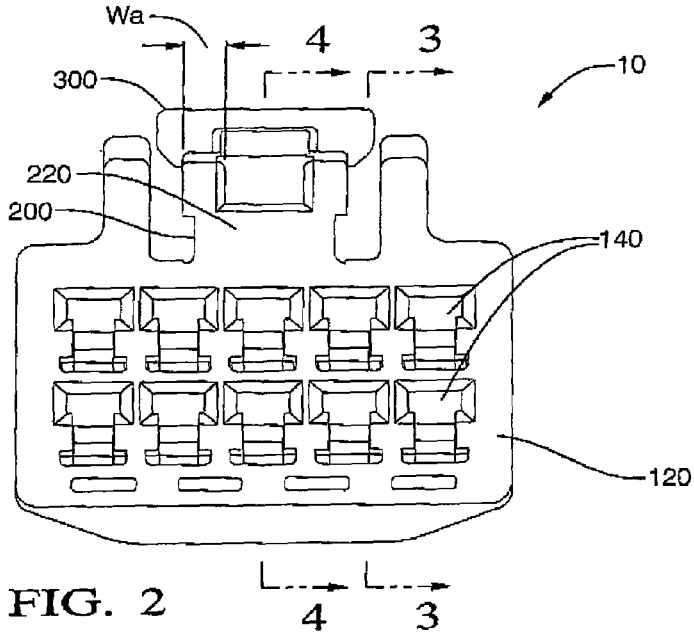
FIG. 2 is a front end view showing a connector according to the present invention.
Figure 3:
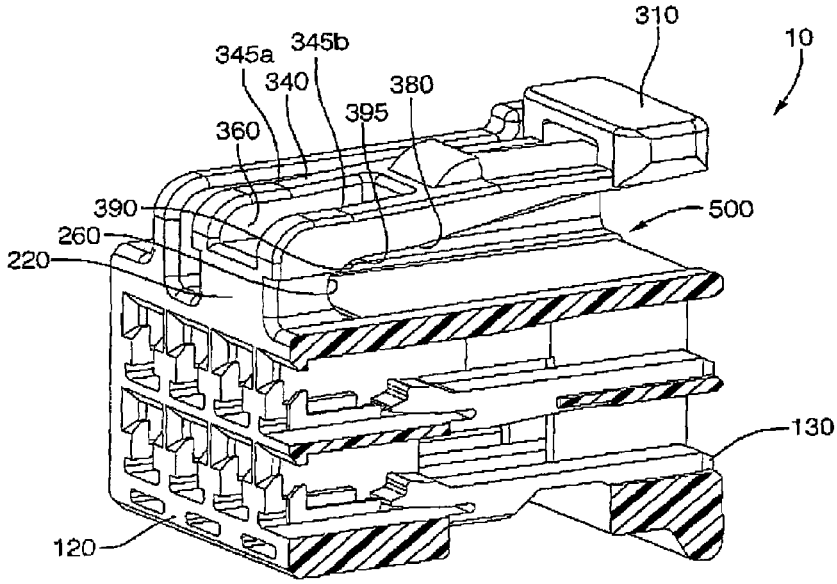
FIG. 3 is a section view taken along lines 3—3 of FIG. 2.
Figure 4:
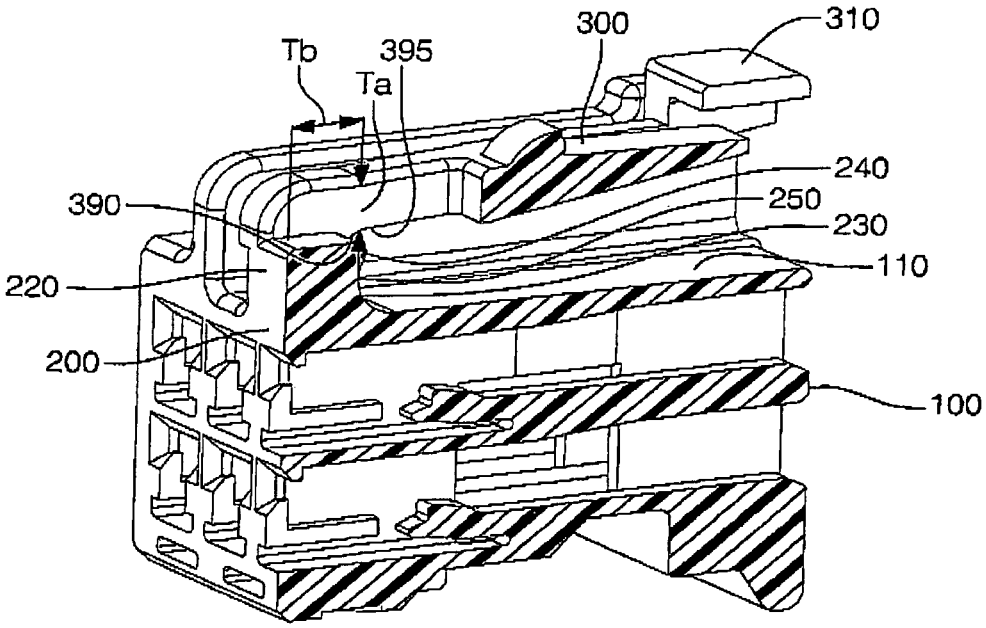
FIG. 4 is a section view taken along lines 4—4 of FIG. 2.
Figure 5:
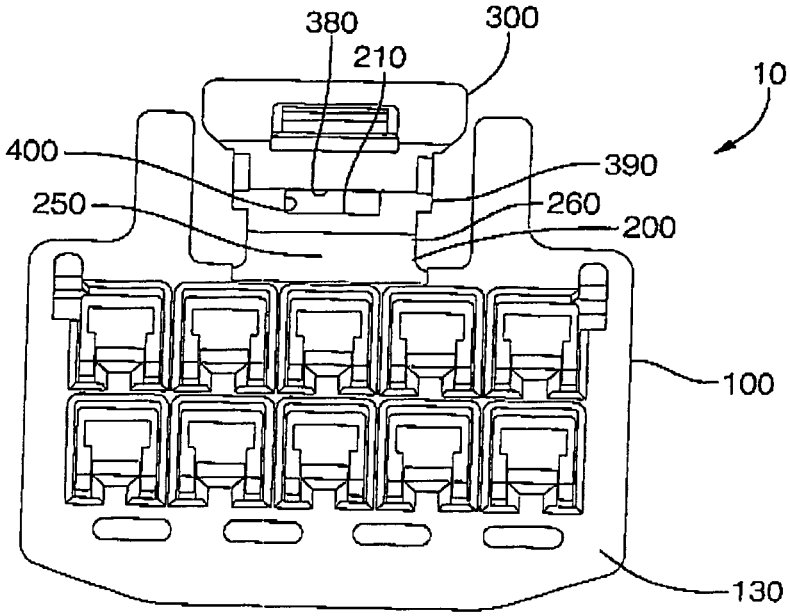
FIG. 5 is a rear end view showing a connector according to the present invention.

A connector 10 according to an exemplary embodiment of the present invention will be described below with reference to FIGS. 1–5. Connector 10 includes a housing 100, a base 200 extending from an outer housing surface 110 of housing 100, and a cantilevered, deflectable locking arm 300 extending from an outer base surface 210 of base 200. Base 200 and locking arm 300 are formed integrally with housing 100.

Housing 100 has a front end 120 and an opposed rear end 130. Outer housing surface 110 extends between front and rear ends 120, 130. A plurality of terminal cavities 140 extends between openings in front and rear ends 120, 130.

Base 200 projects from outer housing surface 110 proximate front end 120 of housing 100. Outer base surface 210 extends in parallel with outer housing surface 110. Base 200 further includes a front side surface 220 and a rear side surface 230 defined in detail below.

Locking arm 300 extends rearwardly from outer base surface 210. Locking arm 300 includes a distal end portion 310 and two spaced apart flexible members 320, 330 extending in parallel between distal end portion 310 and base 200. Locking arm 300 includes an outer surface 340 facing away from outer housing surface 110. A shallow U-shaped or V-shaped indentation 345*a*, 345*b* is formed in outer surface 340 of each flexible member 320, 330. When in an unbiased condition, locking arm 300 extends generally parallel with outer housing surface 110. Each flexible member 320, 330 of locking arm 300 has a beam height, or thickness, Ta measured perpendicular to outer housing surface 110 at indentation 345*a*, 345, respectively. In addition, each flexible member 320, 330 of locking arm 300 has a beam width Wa measured across each respective flexible member 320, 330.

A window 400 extends through locking arm 300 from where locking arm 300 connects to base 200. Window 400 is defined in part by a forward surface 350 of distal end portion 310, and mutually opposing inner side surfaces 360, 370 of flexible members 320, 330, respectively. Window 400 is positioned so that a first portion 410 of window 400 provides an opening through locking arm 300 to outer housing surface 110 and a second portion 420 of window 400 provides an opening through locking arm 300 to outer base surface 210.

An inner surface 380 of locking arm 300 and outer housing surface 110 define a space 500 enabling locking arm 300 to flex from its unbiased condition toward outer housing surface 110 when connector 10 and a mating element (not shown) are being locked to each other. A radiused portion 390 of inner surface 380 extends, in part, continuously from rear side surface 230 of base 200. Locking arm 300 further includes a locking projection 395 extending from distal end portion 310 away from outer housing surface 110.

Front side surface 220 of base 200 is continuous and flush with front end 120 of housing 100. Rear side surface 230 of base 200 faces space 500. Rear side surface 230 consists of a substantially semi-cylindrical arc shaped surface continuous with outer housing surface 110. The semi-cylindrical arc shaped surface is generated about an axis that is substantially parallel to outer housing surface 110 and extending in a side-to-side direction. Inner surface 380 of locking arm 300 is continuous with rear side surface 230 of base 200.

Thus, radiused portion 390 of locking arm 300 is substantially tangent to rear side surface 230. Base 200 has a thickness Tb measured between front side surface 220 and rear side surface 230 in a direction parallel to a direction of unbiased extension of locking arm 300. Rear side surface 230 receives a tensile load when locking arm 300 is displaced away from housing 100. Thickness Tb is greater than locking arm 300 thickness Ta measured perpendicular to outer housing surface 110 to resist breakage of base 200 and locking arm 300. Width Wa and indentations 345*a*, 345*b* formed in each flexible member 320, 330 are established to provide a yield point (generally shown at 395 near the rearward end of radiused portion 390) on locking arm 300, rather than base 200, when locking arm 300 is bent away from outer housing surface 110. In an exemplary embodiment, width Wa of each flexible member 320, 333 is configured to be less than thickness Ta of locking arm 300. This configuration is advantageous to minimize or eliminate material build-up at the location (generally shown at 395) where a hinge is induced as locking arm 300 is bent away from outer housing surface 110.

Outer base surface 210 extends in parallel with outer housing surface 110. A radius or substantially cylindrically generated arc shaped surface 240 extends between outer base surface 210 and rear side surface 230 of base 200. Consequently, an inside portion 250 of rear side surface 230 is continuous with outer base surface 210. An outside portion 260 of rear side surface 230 of base 200 is continuous with radiused portion 390 of inner surface 380 of locking arm 300.

In normal operation, locking arm 300 bends inwardly toward housing 100 during mating with a mating element (now shown). After mating, locking arm 300 returns to a generally unbiased state. In the event that locking arm 300 is excessively bent away from housing 100, hinges are induced in locking arm 300 near base 200 generally at indentations 345*a*, 345*b*. Consequently, locking arm 300 can be deformed outwardly and returned to an unbiased state without causing breakage of locking arm 300 or base 200.

The exemplary embodiments shown and described herein are provided merely by way of example and are not intended to limit the scope of the invention in any way. Exemplary ratios, materials and construction techniques are illustrative only and are not necessarily required to practice the invention. It is intended that the scope of the present invention herein disclosed should not be limited by the particular disclosed embodiments herein, but should be defined only by a fair reading of the claims that follow.

Further modifications and alterations may occur to others upon reading and understanding the specification. It is intended to include all such modifications and alterations insofar as they come within the scope of the invention.

What is claimed is:

1. A connector comprising a housing having an outer surface, a base extending from the outer surface, and a deflectable, cantilevered, locking arm extending from the base;

wherein the base and the locking arm are mutually configured so as to position adjacent to the base an induced binge axis about which the locking arm will rotate as the locking arm is deformed away from the housing;

wherein the locking arm includes a plurality of spaced-apart members defining a window in the region of the induced hinge;

wherein the window provides an opening through the locking arm and extends to an outer surface of the base; and wherein one or more indentations are formed in an outer surface of each member, thereby creating a location of elevated stress concentration.

2. A connector according to claim 1 wherein the window extends from the base to a distal end of the arm.

3. A connector according to claim 1 wherein one or more indentation is formed in an outer surface of each flexible member, proximate the base, thereby creating a location of elevated stress concentration so as to position the induced hinge proximate the base when the locking arm is caused to deform outwardly from the connector housing.

4. A connector according to claim 1, wherein, a beam width of each flexible member is less than the beam height of the locking arm.

5. A connector according to claim 1, wherein the base is configured so that a width of the window at the outer surface of the base is equal to or greater than a maximum cross-sectional dimension of the arm.

6. A connector according to claim 1, wherein the base is configured so that a width of the window at the outer surface of the base is equal to or greater than a maximum cross-sectional dimension of a member of the arm.

7. A connector according to claim 1, wherein an external surface of the base is arc shaped.

8. A connector according to claim 1, wherein an external surface of the base is continuous with an inner surface of the locking arm.

9. A connector comprising:

a housing having an outer housing surface;

a base formed integrally with said housing, said base extending from said outer housing surface to an outer base surface, a side base surface extending between said outer housing surface and said outer base surface; and a deflectable cantilever locking arm formed integrally with said base, said locking arm extending from said outer base surface and projecting, in an unbiased condition, generally parallel with said outer housing surface, said locking arm comprising a distal end portion, and two spaced-apart flexible members extending between said distal end portion and said base, said looking arm having an inner surface facing said outer housing surface, said inner surface being continuous with said side base surface, and said side base surface being continuous with said outer housing surface wherein an outer surface of each flexible member includes one or more indentations in for inducing a yield point when said locking arm is bent outwardly from said outer housing surface.

10. A connector according to claim 9, wherein said side base surface is arc shaped.

11. A connector according to claim 10, wherein a surface of the base that extends between said outer base surface and said side base surface is radiused.

12. A connector according to claim 11, wherein said locking arm has an outer locking arm surface facing away from said outer housing surface, each said flexible member having an indentation in said outer locking arm surface for inducing a yield point when said locking arm is bent away from said outer housing surface.

13. A connector according to claim 12, wherein a thickness of said base measured parallel with a direction of extension of said locking arm is greater than a thickness of said locking arm measured perpendicular to said outer housing surface at each said indentation.

14. A connector according to claim 13, wherein each of said flexible members has a width measured across said flexible member that is less than said thickness of said locking arm measured perpendicular to said outer housing surface.

15. A connector comprising:

a housing having an outer housing surface;

a base formed integrally with said housing, said base extending from said outer housing surface to an outer base surface, said outer base surface extending generally parallel with said outer housing surface, said base having a front base surface and an opposed rear base surface;

a deflectable cantilever locking arm formed integrally with said base, said locking arm extending from said outer base surface and projecting rearwardly from said base, in an unbiased condition, generally parallel with said outer housing surface, said locking arm having an outer locking arm surface facing away from said outer housing surface and an inner locking arm surface facing said outer housing surface, said locking arm comprising a distal end portion, and two spaced apart flexible members extending between said distal end portion and said base;

the base defining a space between said outer housing surface and said inner locking arm surface enabling said locking arm to flex from said unbiased condition toward said outer housing surface when said connector and a mating element are being locked to each other, wherein said inner locking arm surface is continuous with said rear base surface, and said rear base surface is continuous with said outer housing surface;

wherein each said flexible member has an indentation in said outer locking arm surface for inducing a yield point when said locking arm is bent away from said outer housing surface.

16. A connector according to claim 15, wherein said rear base surface is arc shaped, wherein said outer base surface is continuous with said rear base surface, and wherein a surface extending between said outer base surface and said rear base surface is arc shaped.

17. A connector according to claim 15 wherein a thickness of said base measured between said front and rear base surfaces is greater Than a thickness of said locking arm measured perpendicular to said outer housing surface at each said indentation.

18. A connector according to claim 15, wherein said two spaced apart flexible members mutually extend in parallel between said distal end portion and said base.

19. A connector according to claim 15, wherein said distal portion comprises a locking projection extending away from said outer housing surface.

* * * * *